United States Patent [19]

Spiewok et al.

[11] 4,014,497

[45] Mar. 29, 1977

[54] VERTICAL CENTRIFUGE

[75] Inventors: Leonhard Spiewok, Wallisellen; Albert Bucher, Kriens, both of Switzerland

[73] Assignee: Escher Wyss Limited, Zurich, Switzerland

[22] Filed: Apr. 13, 1976

[21] Appl. No.: 676,466

[30] Foreign Application Priority Data

Apr. 22, 1975 Switzerland ..... 005137/75

[52] U.S. Cl. ..... 233/20 R; 233/21; 233/47 R; 210/360 R; 210/380 R

[51] Int. Cl.[2] ..... B04B 11/04

[58] Field of Search ..... 233/19 R, 19 A, 20 R, 233/3, 27, 46, 47 R, 21; 210/360 R, 360 A, 372, 374, 375, 376, 377

[56] References Cited

UNITED STATES PATENTS

| | | | |
|---|---|---|---|
| 3,056,505 | 10/1962 | Andersson | 233/27 X |
| 3,655,124 | 4/1972 | Sommer | 233/46 |
| 3,773,253 | 11/1973 | Laven | 233/20 R |

*Primary Examiner*—George H. Krizmanich
*Attorney, Agent, or Firm*—Robert A. Ostmann

[57] ABSTRACT

A vertical centrifuge comprises a housing provided with a cover. A centrifuge drum is arranged to be rotatable in the housing and has an upper feed opening and a lower discharge opening. A shield is arranged above the discharge opening and comprises a screening wall which covers only a part of the circumference of the discharge opening and is carried and can be displaced by means of a shaft mounted in a holding arrangement and passing through the cover. The holding arrangement comprises means for the rotation of the shaft.

10 Claims, 10 Drawing Figures

Fig.2
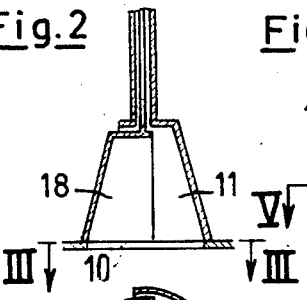
Fig.4
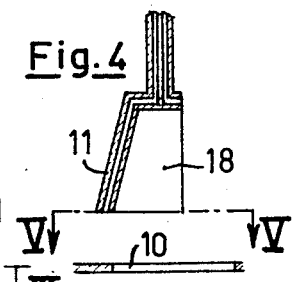
Fig.6
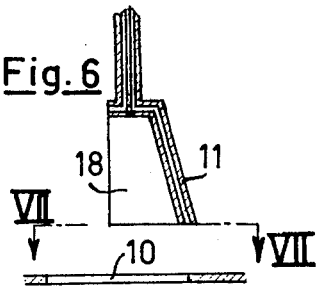
Fig.3
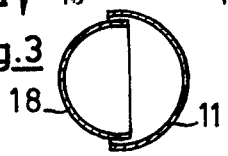
Fig.5
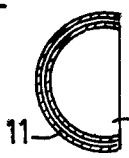
Fig.7
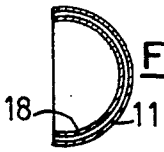
Fig.8
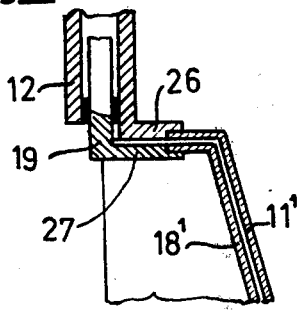
Fig.9
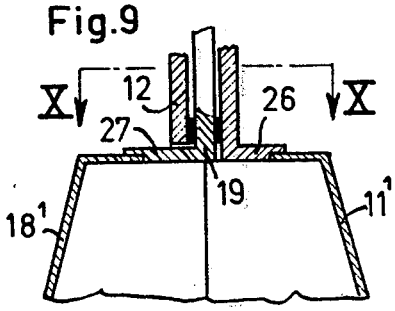
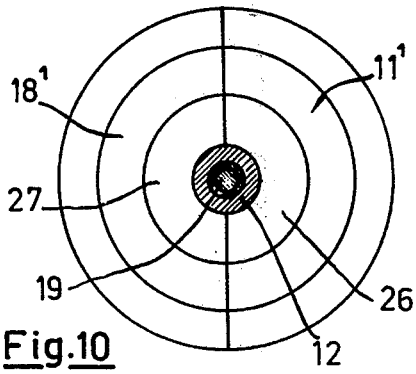
Fig.10

VERTICAL CENTRIFUGE

BACKGROUND OF THE INVENTION

The invention rélates to a vertical centrifuge, with a housing provided with a cover and with a centrifuge drum which is arranged to be rotatable in the housing and which comprises an upper feed opening and a lower discharge opening, while above the discharge opening is arranged a screen or shield, which is carried and can be displaced by means of a holding arrangement with a shaft arranged on the cover.

During the filing of the centrifuge drum with a material which is to be centrifuged and during the washing of the material, the lower discharge opening of the drum has to be covered by means of a screen or shield. This prevents the splashing material which is to be introduced or washed being able, through the discharge opening, to make the material which has already been treated and which is underneath the discharge opening once again wet or dirty. However, with the discharge of the treated material from the drum, the path between a blade or knife of a stripping device and the discharge opening has to be made free.

With one known vertical centrifuge, this is obtained by the fact that the shield covering the discharge opening is raised by displacement and rotation of a shaft of a holding arrangement and is pushed to one side. However, also in this position, the wall of the shield still always obstructs the material which is to be discharged during its passage from the knife of the stripping device to the discharge opening.

SUMMARY OF THE INVENTION

It is the object of the present invention to provide a shielding arrangement for the discharge opening of a vertical centrifuge of the type initially described which, with the discharge of the material from the centrifuge drum, provides an unobstructed path for the material between the stripping knife and the discharge opening for said material.

This object is achieved according to the invention by the shield comprising a screening wall, which covers the discharge opening only over a part of the circumference of the said opening and is carried and can be displaced by means of a shaft mounted in a holding arrangement and passing through the cover, the holding arrangement comprising means for the rotation of the shaft.

With the filing and washing of the material, the screening wall is disposed over a part of the discharge opening circumference between a filling pipe or a washing pipe and prevents the splashing material or washing agent or detergent falling through the discharge opening on to the already treated material underneath said opening. Before the discharge or stripping of the material, the screening wall is so rotated away by the holding arrangement that it covers a different circumference than that covered in the first position, so that the path for the material between the stripping knife and the discharge opening is made free.

If the shaft in the cover is also mounted so that it can be moved along the longitudinal axis and means are provided on the holding arrangement for the displacement of the shaft, an even broader path is produced with the same screening wall for the material from the stripping knife to the discharge opening.

However, with many materials which have to be centrifuged, the drops of the material to be introduced or washed form a mist, so that it becomes essential to cover a larger circumference or the entire circumference of the discharge opening. In accordance with one advantageous form of the invention, this is achieved by the screening wall having associated therewith a second screening wall by which another part of the circumference of the discharge opening can be covered than that covered by the first screening wall and which is carried by means of a second shaft of the holding arrangement, which shaft is guided and mounted to be rotatable coaxially of the shaft of the first screening wall, the holding arrangement comprising means for rotating the shaft carrying the second screening wall into a position in which the two said walls cover an identical part of the circumference of the discharge opening.

Thus, the screening walls cover the entire circumference of the discharge opening during the filling and washing operations. However, while they are rotated before the discharge of stripping of the material into the position in which they cover an identical part of the circumference of the discharge opening, the remaining circumference of the discharge opening remains free for the movement of the material from the stripping knife to the discharge opening.

If means are provided on the holding arrangement for moving the two screening walls together along the longitudinal axis, the passage for the material is even broader when the said walls are displaced.

BRIEF DESCRIPTION OF THE DRAWING

The invention will now be described by way of example, with reference to the accompanying diagrammatic drawings, wherein:

FIGS. 2, 4 and 6 are each a longitudinal section of the screening walls in different operating positions, FIG. 3 is a section on the line III—III of FIG. 2, FIG. 5 is a section on the line V—V of FIG. 4, FIG. 7 is a section on the line VII—VII of FIG. 6, FIGS. 8 and 9 show the screening walls according to another embodiment in different operating positions, and FIG. 10 is a section on the line X—X of FIG. 9.

DESCRIPTION OF THE PREFERRED EMBODIMENTS

Figure 1:
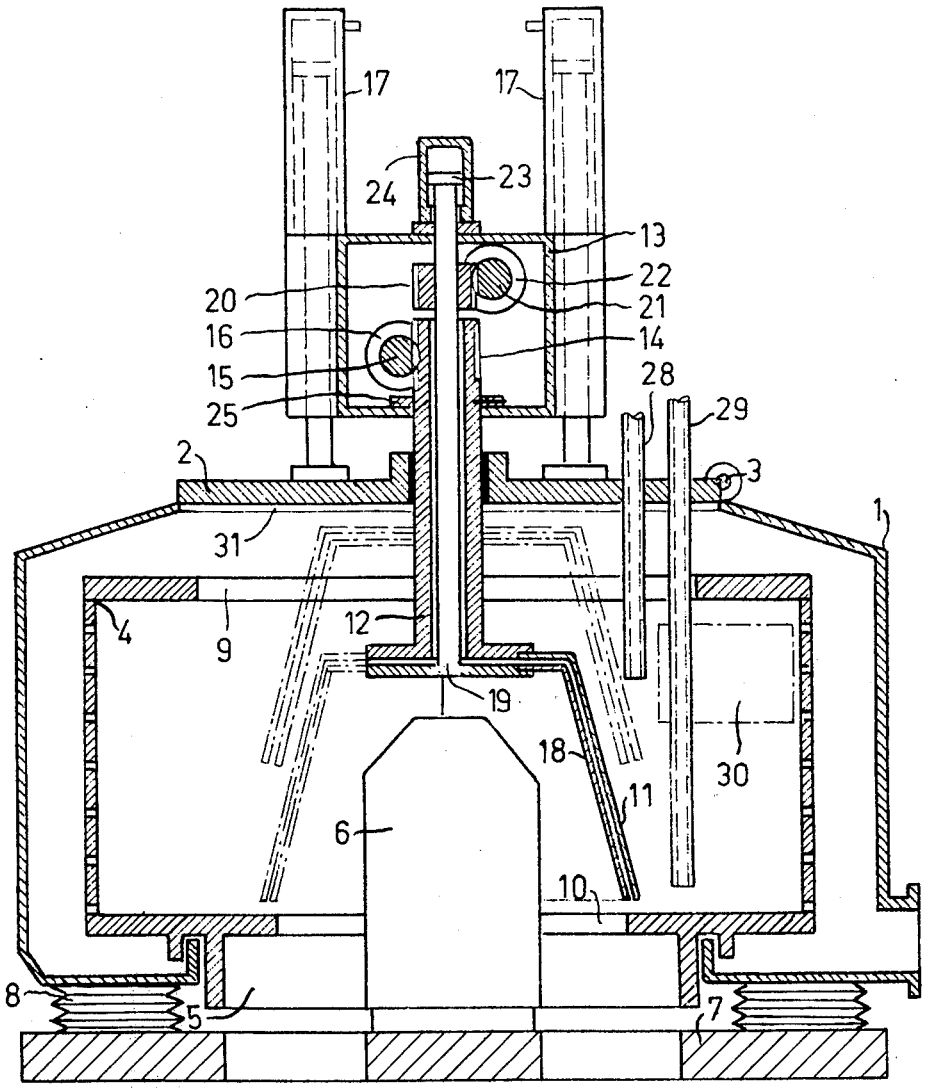
FIG. 1 shows one embodiment in axial longitudinal section.

The vertical centrifuge comprises a housing 1, which is provided with a cover 2. The cover 2 is hinged on the housing 1 by means of a pivot 3. A centrifuge drum 4 is rotatably arranged in the housing 1. The drum 4 comprises a number of spokes 5, which connect the drum 4 to the rotor of a motor 6, the stator of which is fixed on a base plate 7. The housing 1 is connected to the base plate 7 by a number of springs 8.

The centrifuge drum 4 comprises an upper feed opening 9 and a lower discharge opening 10. Arranged above the discharge opening 10 is a first screening wall 11, which is carried and displaceable by means of a first shaft 12 mounted in a holding arrangement 13. The shaft 12 is arranged coaxially of the centrifuge axis and is mounted in the cover 2 so that it can be rotated and also displaced along the longitudinal axis. The shaft 12 is rotated via a toothing 14 on the upper end thereof by a horizontal rack 15 which is moved by means of a servomotor 16 meshing with the said toothing 14. Serving for moving the shaft 12 axially is a lifting mechanism which comprises two servomotors 17 and which shifts the holding arrangement 13 and thus also the shaft 12, which is provided with an immovable flange ring 25.

The first screening wall 11 covers the discharge opening 10 over only a part of the circumference of the latter, as can be seen particularly clearly in FIG. 3.

Associated with the first screening wall 11 is a second screening wall 18, by which can be covered another part of the circumference of the discharge opening 10 than that covered by the first wall 11, as can be seen particularly clearly in FIG. 3. The second wall 18 is carried and is displaceable by means of a second shaft 19, which is guided and mounted to be rotatable coaxially of the first shaft 12. The shaft 19 has a pinion 20 which is connected fast thereto and meshes with a horizontal rack 21, which is moved by means of a servomotor 22. Thus, the wall 18 can be rotated into a position in which the two screening walls 11 and 18 cover an identical part of the circumference of the discharge opening 10, as will be seen particularly clearly in FIGS. 5 and 7.

The second shaft 19 is also mounted to be displaceable longitudinally in the first shaft 12. For the displacement, the second shaft 19 is connected to a piston 23 of a servomotor 24 arranged on the holding arrangement 13.

A lifting mechanism comprising servomotors 17 also serves for longitudinal axial displacement of the two screening walls 11 and 18 together with the holding arrangement 13.

The screening walls 11 and 18 together cover more than the entire circumference of the discharge opening 10, as can be seen particularly clearly in FIG. 3. The second wall 18 is made slightly smaller than the first wall 11, so that it can be nested in the later. Rotated into the position in which they cover more than the entire circumference of the discharge opening 10, the said walls 11 and 18 overlap one another, and this can also be seen particularly clearly in FIG. 3.

The invention is not restricted to the two screening walls 11 and 18 which have been illustrated and it would also be possible to visualise more than two such walls.

In another embodiment of the invention, as illustrated in FIGS. 8, 9 and 10, the screening walls 11[1] and 18[1] together cover exactly the entire circumference of the discharge opening 10 without overlapping. The wall 11[1] is fixed by means of a flange 26 in the form of a half-ring to the bottom and of the shaft 12. The wall 18[1] is fixed to the shaft 19 by means of a flange 27 in the form of a half-ring, which together with the first flange 26 provide a whole ring. Rotated into the position in which the two walls 11[1] and 18[1] cover exactly the entire circumference of the discharge opening 10, the shaft 19 is shifted relatively to the shaft 12, so that the two flanges 26 and 27 are contained in the same plane. Since the two screening walls 11[1] and 18[1] are the same, there is formed a regular bellshaped screen or shield.

The joints between the screening walls can be provided with suitable packing strips.

Referring to FIG. 1, when the centrifuge drum 4 is filled through a filling pipe 28 with a material which is to be centrifuged, the wall 11 is in a position facing the filling pipe 28 and the wall 18 is in a position away from the filling pipe 28, so that the two walls 11 and 18 cover the entire circumference of the discharge opening 10. This position of the screening walls 11, 18 is shown particularly clearly in FIGS. 2 and 3 in respect of the embodiment shown in FIG. 1 and in FIGS. 9 and 10 for the other embodiment.

When the material is washed by means of a detergent, which is supplied through the washing pipe 29, the screening walls 11, 18 remain in the same position as at the time of filling.

With discharge of the washed and dried material from the drum 4 by means of a stripping device, of which only its stripping knife 30 is indicated in chain-dotted lines in FIG. 1, the two walls 11 and 18 are disposed in a position away from the said knife 30 and are moved upwardly towards the cover 2, which position is to be seen particularly clearly in FIGS. 4 and 5. The path for the material from the stripping knife 30 to the discharge opening 10 is thereby made free.

When the cover 2 is opened by being hinged upwardly about the pivot 3, the two walls 11 and 18 are in a position facing the pivot 3 and are moved upwardly towards the cover 2, so that the walls 11, 18 pass through the upper feed opening 9 of the drum 4 and through the opening 31 in the housing 1 as the cover 2 is being opened.

We claim:

1. A vertical centrifuge comprising a. a housing provided with a cover which closes its upper end;

b. a centrifuge drum mounted in the housing for rotation about a vertical axis and having a top inlet opening and a bottom discharge opening;

c. means for leading material through the cover and the inlet opening to a region of the drum located at one side of said axis;

d. stripping means in said region for separating centrifuged material from the drum and thereby facilitating its discharge through the discharge opening;

e. a shielding wall located inside the drum above the discharge opening and extending around only a portion of the circumference of that opening;

f. a shaft extending vertically into the drum through the cover and the inlet opening and connected with the shielding wall; and g. means for rotating the shaft between positions in which the shielding wall is disposed at opposite sides of said axis, h. the shielding wall serving selectively to impede passage of material from said region to the discharge opening when positioned at the same side of the axis as that region, and to permit free passage of material from said region to the discharge opening when positioned at the opposite side of the axis.

2. A centrifuge as defined in claim 1 in which the shaft is coaxial with said vertical axis.

3. A centrifuge as defined in claim 2 which includes means for displacing the shaft in the direction of said axis, whereby the vertical position of the shielding wall may be changed.

4. A centrifuge as defined in claim 1 which includes a. a second shielding wall located inside the drum above the discharge opening and which extends around only a portion of the circumference of that opening; and b. a second shaft coaxial with the first shaft and connected with the second shielding wall, c. the two walls having one relative position in which they cover separate, adjacent portions of the discharge opening, and another relative position in which they cover the same portion of the discharge opening.

5. A centrifuge as defined in claim 4 which includes means for rotating the second shaft.

6. A centrifuge as defined in claim 4 which includes means for displacing both shafts in the direction of said axis.

7. A centrifuge as defined in claim 6 in which the means for displacing both shafts includes means for effecting relative axial movement of the shafts, and means for effecting simultaneous axial movements of the shafts.

8. A centrifuge as defined in claim 5 in which a. the cover is mounted on the housing by hinge means located at the same side of the axis as said region;

b. the shafts are supported on the cover; and c. which includes means for rotating the second shaft, d. whereby the shielding walls may be rotated and displaced vertically to an elevated position at the same side of the axis as the hinge means, and then swung out of the drum through said inlet opening as an incident to opening movement of the cover.

9. A centrifuge as defined in claim 4 in which the two shielding walls are offset from each other in the axial direction; and the circumferential extents of the walls are such that, in said one relative position, the walls cover the entire discharge opening and overlap one another.

10. A centrifuge as defined in claim 4 which includes means for displacing the shafts relatively to each other in the direction of said axis; and the circumferential extents of the walls are such that, in said one relative position, the walls cover the entire discharge opening and abut each other at opposite sides of said axis.

* * * * *